US006305998B1

(12) United States Patent
Schäfer et al.

(10) Patent No.: US 6,305,998 B1
(45) Date of Patent: Oct. 23, 2001

(54) MARINE DRIVE MECHANISM WITH TWIN-ENGINE DISTRIBUTION TRANSMISSION

(75) Inventors: Wilhelm Schäfer; Karl Rasche, both of Witten (DE)

(73) Assignee: A. Friedr. Flender AG, Bocholt (DE)

( * ) Notice: Subject to any disclaimer, the term of this patent is extended or adjusted under 35 U.S.C. 154(b) by 0 days.

(21) Appl. No.: 09/613,780

(22) Filed: Jul. 11, 2000

(30) Foreign Application Priority Data

Jul. 16, 1999 (DE) ..... 199 32 873
Nov. 13, 1999 (DE) ..... 199 54 692

(51) Int. Cl.[7] ..... B63H 21/30
(52) U.S. Cl. ..... 440/75; 440/111
(58) Field of Search ..... 440/111, 75; 248/637, 248/638, 672

(56) References Cited

U.S. PATENT DOCUMENTS 3,929,089 * 12/1975 Lambrecht et al. ..... 440/111
4,978,320 * 12/1990 Chaplin et al. ..... 440/111
5,022,628 * 6/1991 Johnson et al. ..... 440/111

* cited by examiner

*Primary Examiner*—Stephen Avila
(74) *Attorney, Agent, or Firm*—Max Fogiel

(57) ABSTRACT

A Marine drive mechanism has a twin-engine distribution transmission for driving a propeller-shaft train (12) supported on bearings (4). The drive mechanism (1) and the transmission (3), which is rigidly connected to it, being fastened to the bottom (6) of the hull. A pressure bearing (23) accommodates and transmits the thrust exerted by the propeller (5) by way of the propeller-shaft train. A coupling (3) engages and disengages the drive mechanism. The drive mechanism and the transmission are individually supported, the drive mechanism by resilient supports (9) and the transmission by resilient supports (14) and resilient bearings (13). The pressure bearing is built into the transmission. The transmission bearings (13) are integrated into a separate post (19) rigidly fastened to the bottom and are attached to the walls (11) of the transmission.

9 Claims, 5 Drawing Sheets

MARINE DRIVE MECHANISM WITH TWIN-ENGINE DISTRIBUTION TRANSMISSION

BACKGROUND OF THE INVENTION

The present invention concerns a marine drive mechanism with a twin-engine distribution transmission.

The Diesel engines in current passenger ships, cruise ships and ferries for instance, are resiliently supported. Naval ships, furthermore, require very quiet hulls to prevent detection by SONAR, and their engines are accordingly also resiliently supported. Engines and transmissions are mounted on a common resiliently supported platform. A pressure bearing rigidly mounted on the vessel's bottom reliably transmits the propeller thrust, and a special displacement coupling transmits torque from the transmission to the propeller while ensuring low hull noise between the transmission and the propeller-shaft train. There is a drawback to marine drive mechanisms of this genus. Although the engines and transmission are resiliently supported well enough to decrease the emission of hull noise, noise can still be transmitted into the hull by way of the propeller-shaft train and easily identified as "water noise". The ability of SONAR to identify not only the ship's class but the individual ship as well is known.

SUMMARY OF THE INVENTION

The object of the present invention is to improved twin-engine distribution transmission of the aforesaid genus wherefrom essentially no hull noise is emitted and whereby the transmission will not be as long and will be more cost effective.

Since the engines and the transmission are separately supported and since the frequency of the support can be tuned to that of the engines and transmission, the present invention provides the advantages over conventional designs of acoustic decoupling and fine tuning. Hull noise can accordingly be extensively decreased. Positioning the resilient supports on the same level as or on each side of the longitudinal axis of the propeller-shaft train prevents detrimental tilting moments from being exerted on the pressure bearing or on the meshing of the cogs in the equipment. The transmission can even be optimally mounted on three points. It can be accommodated in a shorter space because the conventional and more complicated separate pressure bearing and displacement coupling are no longer necessary. If the resilient supports are on the same level as the longitudinal axes of the propeller-shaft train, the transmission will be much easier to align in spite of thermal expansion, and no special alignment procedures will be necessary.

Several embodiments of the present invention will now be specified by way of example with reference to the accompanying drawing, wherein

DESCRIPTION OF THE PREFERRED EMBODIMENTS

Figure 1:
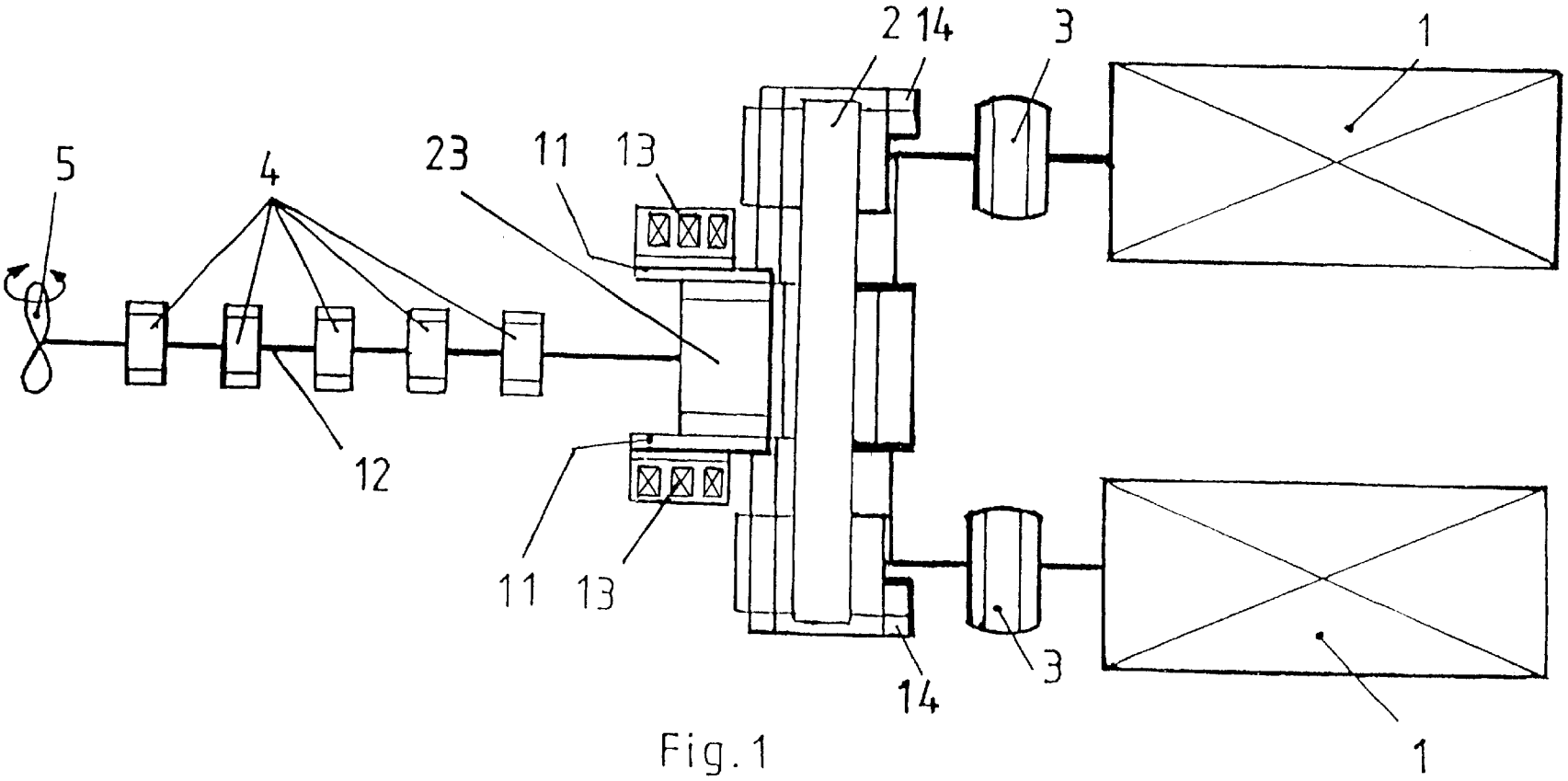
FIG. 1 is an overhead view of a resiliently supported marine drive mechanism.

The present marine drive mechanism if preferably provided with two parallel drivers in the form of Diesel engines

1, each rigidly connected to a transmission 2 by way of a variable coupling 3. Transmission 2 also connects to a propeller-shaft train 12 that rests on bearings 4. A propeller 5, which can have a variable pitch, is mounted on one end of propeller-shaft train 12. The other end of the train extends into transmission 2. Transmission 2 includes a pressure bearing 23 that accommodates and transmits the thrust exerted by propeller 5 by way of train 12. Each engine 1 is individually supported on the ship's bottom 6 by a resilient support 9. The end of transmission 2 toward the engines is supported on the ship's bottom 6 by two resilient supports 14, and the end remote from the engines by a resilient bearing 13. Bearing 13 is integrated into a separate post 19 fastened to bottom 6 and is itself attached to the walls 11 of transmission 2. Since walls 11 are positioned on each side of the pressure bearing 23 in transmission 2, the transmission is suspended at one end from the walls and rests at the other, at the end toward the engine, on supports 14.

Since supports 14 accommodate the weight of the transmission along with the forces deriving from torque, much less noise is transmitted to bottom 6 from transmission 2. The supports 14 at the end toward the engines are positioned below the longitudinal axis of propeller-shaft train 12 in FIG. 2 and in FIG. 3 on the same level as the train. Positioning the supports on the same level as the axis essentially simplifies aligning the transmission even taking thermal expansion into consideration.

The resilient bearing 13 integrated into post 19 consists of a concentric rubber sleeve 18 vulcanized into a steel bushing 15. A bolt 16 secured to the wall 11 of transmission 2 engages bearing 13. Bearing 13 is axially secured to bolt 16 by a screw 20. Gaskets 21, preferably of hard rubber, are interposed between wall 11 and post 19 and between post 19 and a washer 17. Gaskets 21 and rubber sleeve 18 decrease the transmission of noise to post 19 from transmission 2. Post 19 is rigidly secured to bottom 6.

Figure 2:
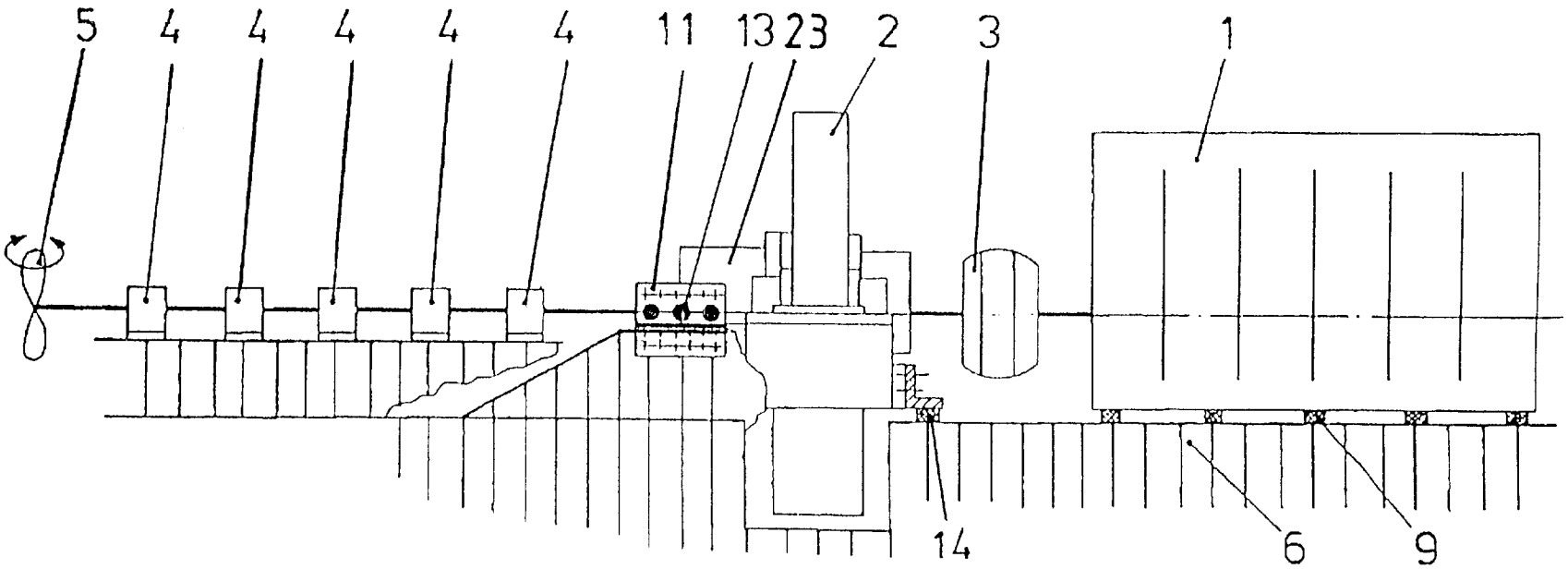
FIG. 2 is a lateral view of the marine drive mechanism.
Figure 3:
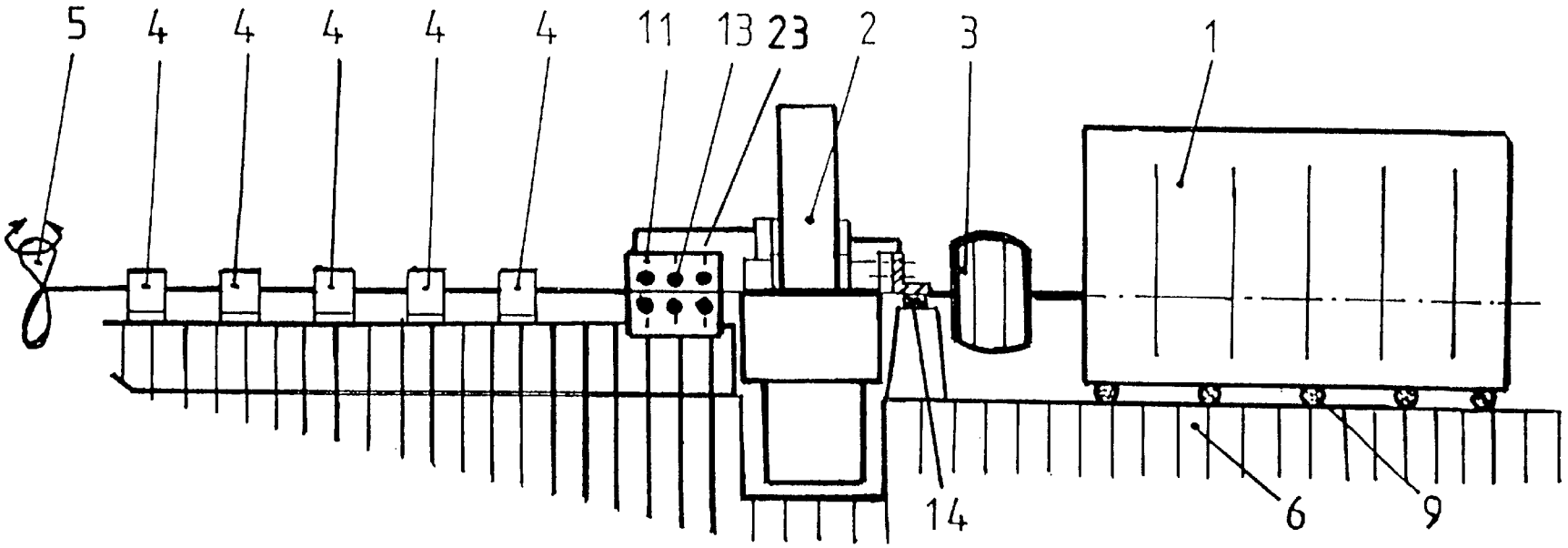
FIG. 3 is a lateral view of another embodiment of a resiliently supported marine drive mechanism.
Figure 4:
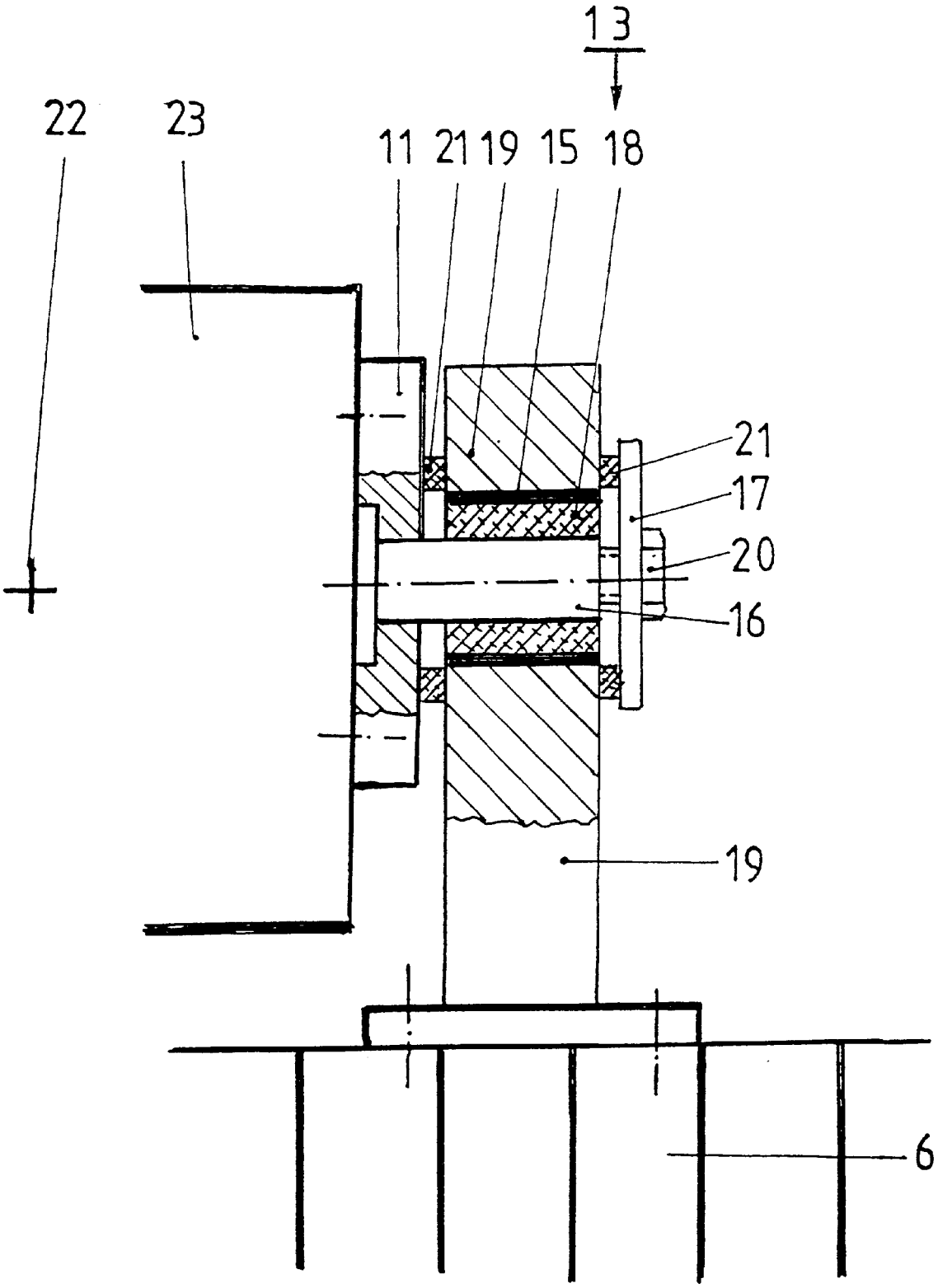
FIG. 4 is a longitudinal section through a resilient bearing.
Figure 5:
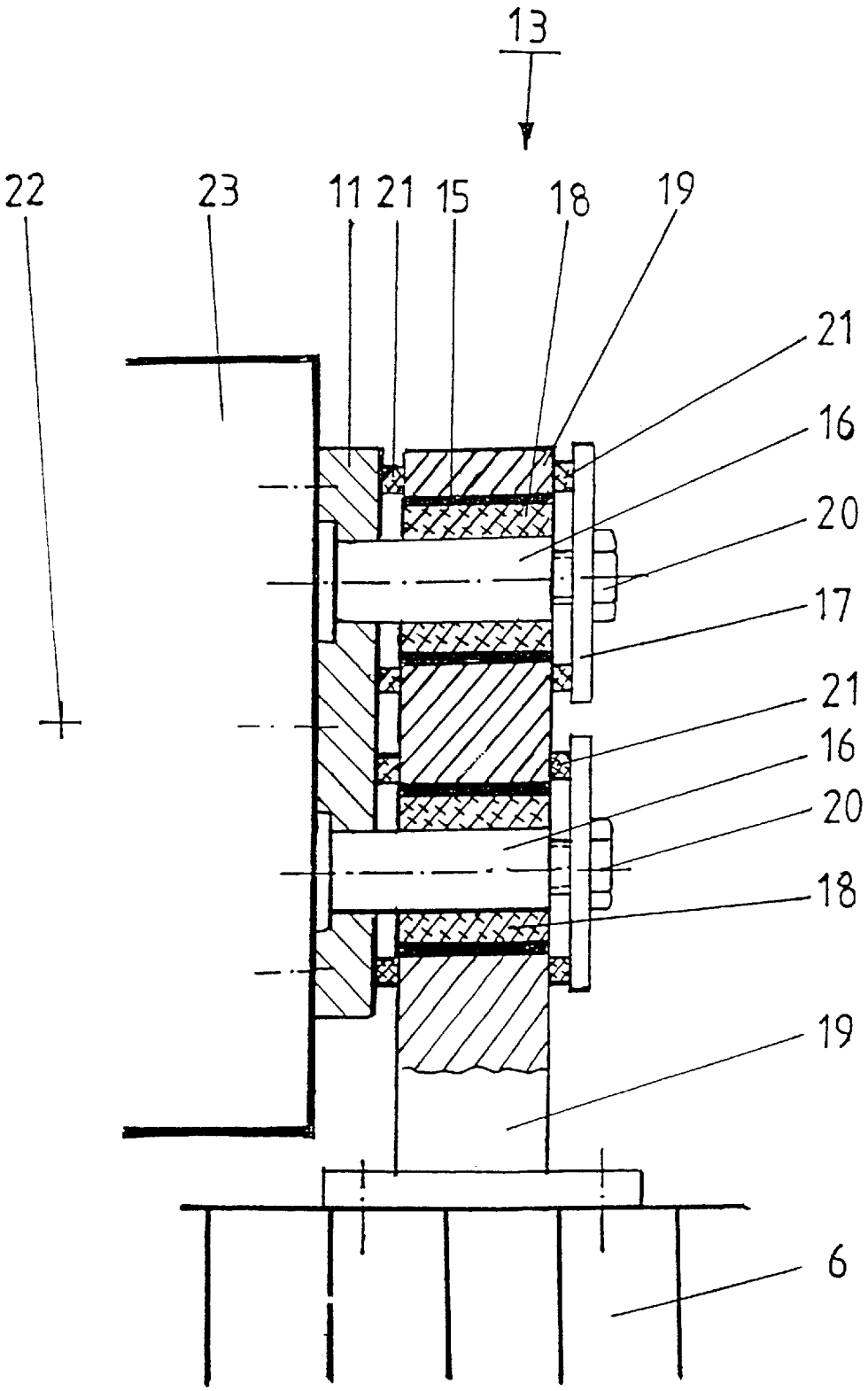
FIG. 5 is a longitudinal section through another embodiment of a resilient support.

The bolt 16 that accommodates the propeller's thrust, and hence supports 13 are in FIGS. 2 and 4 positioned aligned at the level of the transmission's takeoff shaft 22, in the same plane as propeller-shaft train 12. Supports 13 can, however, alternatively be positioned as illustrated in FIGS. 3 and 5 in two rows equidistant from each side of takeoff shaft 22 and propeller-shaft train 12.

The embodiment of a marine drive mechanism specified herein will eliminate a significant component of hull noise in that engines 1 are installed separate and resilient and in that the intimation can be tuned to the frequency of the engines. Since the transmission is also installed separate and resilient, its installation can be tuned to that of the transmission, which is considerably higher than that of the engines. The individual and resilient installation of the different components and the possibility of individually tuning their frequencies results in acoustic separation and allows fine frequency adjustment. Engineering principles indicate that a single individually supported twin-engine distribution transmission with a built-in pressure bearing 23 would tend to tilt when resiliently supported. The propeller thrust, which constitutes a multiple of the transmission's weight, would, due to the lever arm of the result tiling moment toward the transmission's support from the longitudinal axis of the propeller shaft and to the resulting tilting moment, force the transmission to tilt toward the engines. The integrated pressure bearing 23 could accordingly be destroyed by local overloading, and the meshing could also be detrimentally affected all the way to the most remote corner supports, leading to damage to the cogs.

Such a tilting moment on transmission 2 is prevented in that resilient bearing 13 has either been raised to the level of the propeller shaft's longitudinal axis or is located on each side of the transmission. The propeller's thrust is accordingly transmitted to post 19 from transmission 2 with no inflecting lever arm, the post itself being rigidly secured to bottom 6. The walls 11 of transmission 2 are positioned on each side of pressure bearing 23 such that the transmission is suspended from them at one end and at the other, the end toward the engines, supported by supports 14 in such a way that the bearing forces deriving from the torque are accommodated along with the gravitational forces. Supports 14 can preferably be fine-adjusted by hydraulic components to eliminate any displacement of the transmission resulting therefrom. The transmission will accordingly be ideally and solidly supported on three points and in alignment, and cannot be affected by distortions in the hull.

What is claimed is:

1. A marine drive mechanism with a twin-engine distribution transmission for driving a propeller-shaft train with a propeller bearings supporting said propeller-shaft train; a transmission rigidly connected to the drive mechanism, said transmission and said drive mechanism being fastened to a bottom of a hull; a pressure bearing accommodating and transmitting thrust exerted by said propeller by way of said propeller-shaft train; a coupling drive mechanism; said drive mechanism and said transmission being individually supported, said drive mechanism being supported by first resilient supports and said transmission being supported by second resilient supports and resilient transmission bearings; said pressure bearing being built into said transmission; said transmission bearings being integrated into a seperate post rigidly fastened to said bottom and being attached to walls of said transmission.

2. A marine drive as defined in claim 1, wherein said resilient bearings are on the same level as a longitudinal axis of said propeller-shaft train.

3. A marine drive as defined in claim 1, wherein said resilient bearings are on each side of a longitudinal axis of said propeller-shaft train.

4. A marine drive as defined in claim 1, wherein said second resilient supports are on the same level as a longitudinal axis of said propeller-shaft train.

5. A marine drive as defined in claim 1, said first resilient supports for said drive machanism and said second resilient supports for said transmission are optionally individually acoustically fine-tunable with respect to hull noise.

6. A marine drive as defined in claim 1, wherein said transmission is mounted ideally on three points by way of said second resilient supports and said resilient bearings.

7. A marine drive as defined in claim 1, wherein said second resilient supports are torque-accommodating supports and are fine-tuned.

8. A marine drive as defined in claim 1, wherein said second resilient supports can be raised and lowered by hydraulic mechanisms.

9. A marine drive as defined in claim 1, for use in industrial and naval shipbuilding for high-speed vessels in critical applications.

* * * * *